US009333745B2

(12) United States Patent
Hasegawa

(10) Patent No.: US 9,333,745 B2
(45) Date of Patent: May 10, 2016

(54) PRINTING CONTROL APPARATUS AND PRINTING CONTROL METHOD

(71) Applicant: SEIKO EPSON CORPORATION, Tokyo (JP)

(72) Inventor: Tomonaga Hasegawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/633,297

(22) Filed: Feb. 27, 2015

(65) Prior Publication Data

US 2015/0266291 A1 Sep. 24, 2015

(30) Foreign Application Priority Data

Mar. 19, 2014 (JP) ..... 2014-056102

(51) Int. Cl.
*B41J 2/07* (2006.01)
*B41J 2/04* (2006.01)
*B41J 2/045* (2006.01)

(52) U.S. Cl.
CPC ..... *B41J 2/04581* (2013.01); *B41J 2/04568* (2013.01); *B41J 2/04588* (2013.01)

(58) Field of Classification Search
CPC ..... B41J 2/04541; B41J 2/04581; B41J 2/04568; B41J 2/04588
USPC ..... 347/57
See application file for complete search history.

(56) References Cited

U.S. PATENT DOCUMENTS 4,686,539 A * 8/1987 Schmidle et al. ..... 347/15
5,285,215 A * 2/1994 Liker ..... 347/11
7,384,112 B2 6/2008 Hasegawa

FOREIGN PATENT DOCUMENTS

JP 2006-346936 A 12/2006

* cited by examiner

*Primary Examiner* — Stephen Meier
*Assistant Examiner* — Alexander D Shenderov
(74) *Attorney, Agent, or Firm* — Global IP Counselors, LLP

(57) ABSTRACT

A printing control apparatus configured to use a recording head where a plurality of nozzles are arranged in a row formation to discharge ink droplets from each of the nozzles by individually supplying predetermined driving power with regard to actuators, and configured to discharge the ink droplets with different discharge speeds so that subsequent ink droplets catch up with and combine together with prior ink droplets that are continuously discharged before the prior ink droplets land on a printing medium. The printing control apparatus includes a control section configured to drive the actuators in the recording head so that dots that are in a region where a nozzle usage rate is higher than a predetermined threshold are printed due to ink droplets, where ink droplets that are continuously discharged combine together in air, attaching to the printing medium.

8 Claims, 13 Drawing Sheets

Vh1 < Vh2 < Vh3

| | 1stP | 2ndP |
|---|---|---|
| S | OFF | ON |
| L | ON | ON |

Fig. 7

| PG | NPIth |
|---|---|
| ~1mm | 150 |
| ~2mm | 125 |
| 2mm~ | 100 |

Fig. 11

| PRINTING MEDIUM | | |
|---|---|---|
| ◎ | NORMAL PAPER | (80) |
| ○ | INK JET PAPER | (60) |
| ○ | GLOSSY PHOTO PAPER | (30) |

Fig. 12

PRINTING CONTROL APPARATUS AND PRINTING CONTROL METHOD

CROSS-REFERENCE TO RELATED APPLICATIONS

This application claims priority to Japanese Patent Application No. 2014-056102 filed on Mar. 19, 2014. The entire disclosure of Japanese Patent Application No. 2014-056102 is hereby incorporated herein by reference.

BACKGROUND

1. Technical Field

The present invention relates to a printing control apparatus and a printing control method where it is possible for ink droplets to be landed on a printing medium after being combined together in air.

2. Related Art

In recent years, it is known that disturbances which are referred to as ripple marks occur when small ink droplets are discharged with high density. It is thought that ripple marks occur due to the discharge path of ink droplets being warped due to an air flow which occurs when moving a carriage where a recording head is provided and an air flow which occurs when ink droplets are discharged from nozzles.

On the other hand, a printing apparatus which is disclosed in JP-A-2006-346936 (PTL 1) is known for landing ink droplets on a printing medium after being combined together in air.

SUMMARY

In the printing apparatus which is disclosed in PTL 1, ink droplets which are continuously discharged are landed on a printing medium after being combined together in air. It is thought that it is difficult for the effects of ripples marks to be received since weight of the ink droplets increases due to a plurality of the ink droplets being combined together.

On the other hand, ripples marks do not always occur. Accordingly, ink droplets which are combined together are not always necessary. Granularity deteriorates if ink droplets where the weight is increased are always used.

The present invention takes precautions against ripple marks being generated such that granularity does not deteriorate in circumstances where it is difficult for ripple marks to be generated.

The present invention is a printing control apparatus configured to use a recording head where a plurality of nozzles that respectively link with predetermined ink paths are arranged in a row formation to discharge ink droplets from each of the nozzles by individually supplying predetermined driving power with regard to actuators that are respectively arranged in the ink paths, and configured to discharge the ink droplets with different discharge speeds so that subsequent ink droplets catch up with and combine together with prior ink droplets that are continuously discharged before the prior ink droplets land on a printing medium. The printing control apparatus includes a control section which drives the actuators in the recording head so that dots that are in a region where a nozzle usage rate is higher than a predetermined threshold are printed due to ink droplets, where ink droplets that are continuously discharged combine together in air, attaching to the printing medium.

In the configuration described above, the printing control apparatus uses the recording head where the plurality of nozzles, which respectively link with the predetermined ink paths, are arranged in a row formation, ink droplets are discharged from each of the nozzles due to predetermined driving power being individually supplied with regard to the actuators which are arranged in each of the ink paths. In addition, in order for the ink droplets to combine together in air, ink droplets are discharged with different discharge speeds so that the subsequent ink droplets catch up with and combine together with the prior ink droplets, which are continuously discharged, before the prior ink droplets land on the printing medium.

Furthermore, the control section drives the actuators in the recording head so that dots, which are in a region where a nozzle usage rate is higher than the predetermined threshold, are printed due to ink droplets, where the ink droplets which are continuously discharged combine together in air, attaching to the printing medium.

Ink droplets are discharged at the same time from many of the nozzles when the nozzle usage rate is high, and it is easy for ripple marks to occur due to disturbances in an air flow which is generated by ink droplets at this time. For this reason, the effects of ripple marks are prevented by discharging ink droplets where the weight is increased due to ink droplets which are continuously discharged being combined together in air depending on the regions where the nozzle usage rate is high.

As an aspect of the present invention, the control section may be configured to discharge the subsequent ink droplets so as to combine together with the prior ink droplets with regard to the dots that are in the region where the nozzle usage rate is higher than the predetermined threshold, and is configured to discharge the subsequent ink droplets and the prior ink droplets with regard to the printing medium so as to land at the same position at substantially the same time with regard to dots that are in a region where the nozzle usage rate is the predetermined threshold or less.

In the configuration described above, ink droplets, where the weight is increased due to the subsequent ink droplets being discharge so as to combine together with the prior ink droplets, travelling through air and landing at predetermined positions on the printing medium without the effects of air flow being received with regard to dots which are in a region where the nozzle usage rate is higher than the predetermined threshold. On the other hand, the weight of one of the ink droplets is increased and granularity does not deteriorate due to the subsequent ink droplets and the prior ink droplets being discharged with regard to the printing medium so as to land at the same position at substantially the same time with regard to dots which are in a region where the nozzle usage rate is the predetermined threshold or less.

Here, it is not necessary for ink droplets to be continuously discharged and granularity does not deteriorate with regard to smaller dots which are in a region where the nozzle usage rate is the predetermined threshold or less.

As an aspect of the present invention, the control section may include a driving circuit that is configured to supply driving power with a plurality of waveforms that are respectively supplied with regard to each of the actuators, and a nozzle usage rate acquiring section that is configured to acquire a usage rate for a plurality of nozzles that are arranged in a row formation in each predetermined region per unit of time. The control section may be further configured to switch waveforms of the driving power that are supplied based on the nozzle usage rate that is acquired by the nozzle usage rate acquiring section.

In order for the subsequent ink droplets to catch up with and combine together with the prior ink droplets, which are continuously discharged, before the prior ink droplets land on the printing medium, it is necessary that the discharge speed of the subsequent ink droplets is faster than the discharge speed of the prior ink droplets and this speed is so that the subsequent ink droplets catch up with and combine together with the prior ink droplets immediately after discharging. Since there is a property where the discharge speed of ink droplets relies on the energy when the actuator is driven, it is possible for the driving circuit to supply driving power with a plurality of waveforms which are supplied with regard to each of the actuators in order to switch between whether the subsequent ink droplets combine together or do not combine together with the prior ink droplets. In addition, it is possible to realize control such that the ink droplets combine together for regions where this is necessary and do not combine together for regions where this is not necessary if the waveform of the driving power which is supplied is switched based on the usage rate since the nozzle usage rate acquiring section acquires the usage rate for a plurality of the nozzles, which are arranged in a row formation in each of the predetermined regions, per unit of time.

As an aspect of the present invention, the control section may be configured to estimate the region where the nozzle usage rate is higher than the predetermined threshold based on printing data, and may be configured to perform dot allocation processing that create large dots that are created by combining together the prior ink droplets and the subsequent ink droplets that are continuously discharged at the region.

The nozzle usage rate is exactly established by performing rasterization and it is necessary to rely on hardware in order for controlling to be switched at this point in time. By doing this, there is a possibility that there is a limit to the printing apparatuses where it is possible for the present invention to be applied. In contrast to this, although not exact, it is possible to estimate the region where the nozzle usage rate is higher than the predetermined threshold based on printing data. On top on this, it is easy to generate large dots where ink droplets are combined together on the basis of the estimate and it is possible to reduce the limits on the printing apparatuses where it is possible for the present invention to be applied if dot allocation processing is performed so that there are large dots which are created by combining together the prior ink droplets and the subsequent ink droplets which are continuously discharged at the region.

As an aspect of the present invention, the control section may be configured to modify a threshold for whether or not to combine together the prior ink droplets and the subsequent ink droplets that are continuously discharged according to a distance between the recording head and the printing medium.

There are circumstances where it is easy for ripple marks to occur and circumstances where it is not easy for ripple marks to occur, and the extent of the distance between the recording head and the printing medium has an effect. For this reason, it is effective if the threshold is set so that it is easier for ink droplets to combine together in circumstances where this distance is such that it is easy for ripple marks to occur and the threshold is set so that it is difficult for ink droplets to combine together in circumstances where this distance is such that it is difficult for ripple marks to occur.

As an aspect of the present invention, the control section may be configured to modify a threshold for whether or not to combine together the prior ink droplets and the subsequent ink droplets that are continuously discharged according to a parameter that represents the difficulty of bleeding in the printing medium.

There is a tendency for it to be difficult for ripple marks to occur even when there are deviates in the landing positions of ink droplets since ink bleeds at the periphery edges in a case where it is easy for bleeding to occur in the printing medium. For this reason, it is effective if, according to the parameter which represents the difficulty of bleeding in the printing medium, the threshold is set so that it is easier for ink droplets to combine together since it is easy for ripple marks to occur if it is difficult for bleeding to occur and the threshold is set so that it is difficult for ink droplets to combine together since it is difficult for ripple marks to occur if it is easy for bleeding to occur.

As an aspect of the present invention, the control section may be configured to print using single dots in a region where the nozzle usage rate is the predetermined threshold or less based on the nozzle usage rate.

It is difficult for ripple marks to occur in a region where the nozzle usage rate is low. Furthermore, it is particularly easy for deteriorations in granularity to stand out. For this reason, deteriorations in granularity are prevented with printing using single dots and ink droplets where the weight is increased in addition to controlling of whether or not the ink droplets are combined together.

The technical concept which is applied in the present invention is not realized only through the aspect of the printing control apparatus and it is possible for the present invention to be comprehended as, for example, an invention of a printing control method which has processing steps which are executed by the printing control apparatus described above, an invention of a program which executes processing, which is implemented by the printing control apparatus described above, using hardware (a computer), and the like. In addition, the printing control apparatus may be realized using a single apparatus, may be realized as a system which consists of a plurality of apparatuses, or may be built into a certain product (for example, a printing apparatus).

According to the present invention, it is difficult for effects of air flows to be received and it is difficult for ripple marks to occur as a result since ink droplets where the weight of the ink is large are attached to a printing medium on the basis of conditions where it is easy for ripple marks to occur, and it is possible to prevent deterioration in granularity due to ink droplets where the weight of the ink is large being attached to a printing medium according to requirements.

BRIEF DESCRIPTION OF THE DRAWINGS

Referring now to the attached drawings which form a part of this original disclosure:

FIG. 7 is a diagram illustrating correspondence between driving waveforms, small dots, and large dots;

FIG. 11 is a diagram illustrating correspondence between distances between a recording head and a printing medium and a threshold for a nozzle usage rate;

FIG. 12 is a diagram illustrating a parameter and a UI which relates to the difficulty of bleeding.

DETAILED DESCRIPTION OF EMBODIMENTS

An embodiment of the present invention is described below based on the diagrams.

(1) Outline Explanation of Apparatus Configuration

Figure 1:
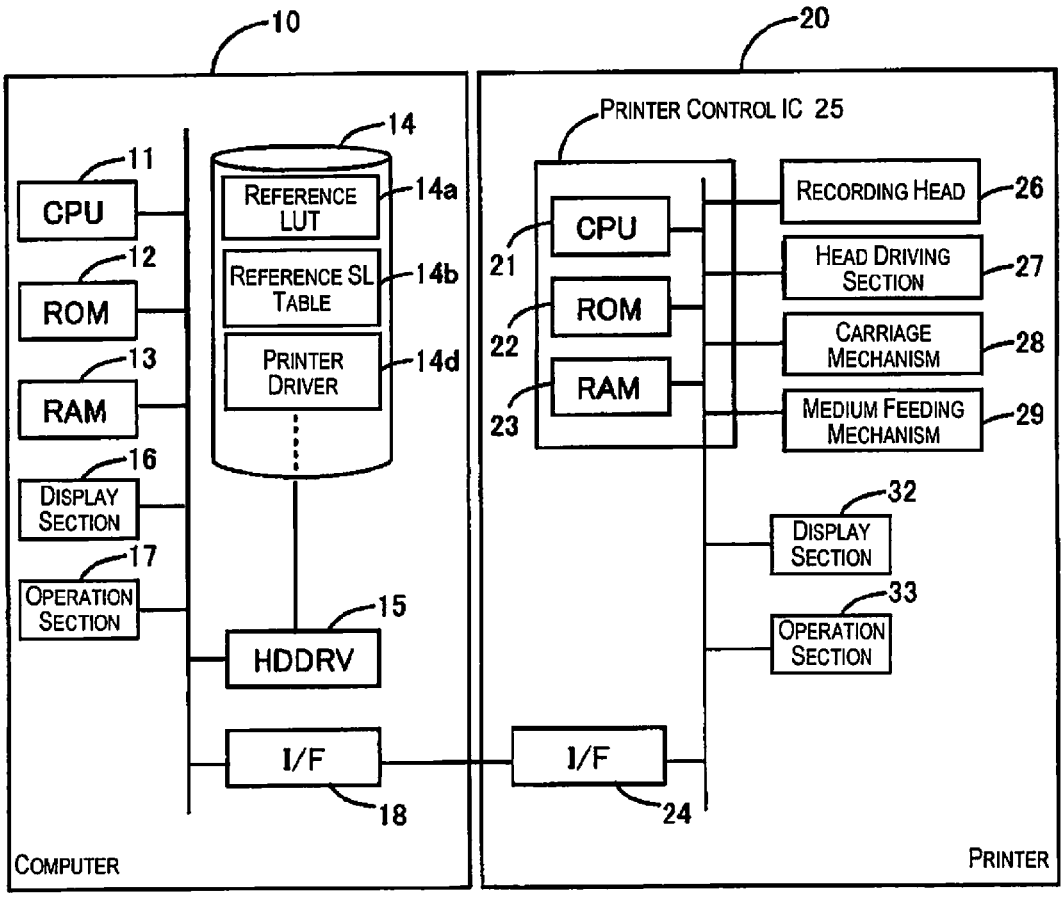
FIG. 1 is a block diagram illustrating a printing system where a printing control apparatus of the present invention is applied.

FIG. 1 illustrates a printing control apparatus according to an embodiment of the present invention using a block diagram.

The present system has, for example, a computer 10 and a printer 20. The computer 10 and/or the printer 20 are equivalent to an example of the printing control apparatus of the present invention. The printing control apparatus is the agent in executing a printing control method. In the computer 10, a CPU 11, which is the center for computation processing, controls the entirety of the computer 10 via a system bus. The bus is connected to a ROM 12, a RAM 13, and various types of interfaces (such as an I/F 18) and is also connected to a hard disk (HD) 14, which is a storage means, via a hard disk drive (HDDRV) 15. An operating system, an application program, a printer driver 14*d*, and the like are stored on the HD 14, and these are appropriately read out from the RAM 13 and executed using the CPU 11.

In addition, a reference LUT 14*a* which is a color conversion look up table (LUT) where color information in a predetermined output color system is associated with a plurality of grid points in a predetermined input color system, a reference SL table 14*b* which is a dot allocation table where gradation data which represents amounts of ink is converted into gradation data which represents amounts for forming a plurality of types of dots where the amounts of ink differ, and the like are stored on the HD 14. The printer driver 14*d*, the LUT, and table will be described later. Furthermore, the computer 10 is provided with a display section 16 which is configured using, for example, a liquid crystal display, an operation section 17 which is configured using, for example, a keyboard, a mouse, a touch pad, a touch panel, and the like.

The printer 20 is an example of a printing apparatus which is controlled by the computer 10. It is obvious that the printer 20 may be an apparatus which is able to realize printing processing by functioning autonomously without relying on controlling by the computer 10. In the printer 20, an I/F 24 is connected to an I/F 18 on the computer 10 side such that it is possible to communicate by wire or wirelessly, and a printer control IC 25 or the like is connected via a system bus. In the printer control IC 25, a CPU 21 appropriately reads out software (firmware) which is stored in a ROM 22 or the like from an RAM 23 and executes predetermined controlling. The printer control IC 25 is an IC which executes controlling mainly for printing processing and controls each section by being connected to each section of a recording head 26, a head driving section 27, a carriage mechanism 28, and a medium feeding mechanism 29. The recording head 26 will be described later.

The carriage mechanism 28 is a driving apparatus which is controlled by the printer control IC 25 and moves a carriage, which is not shown in the drawings, back and forth along a guide rail, which is not shown in the drawings, which is provided in the printer 20. The recording head 26 is mounted in the carriage and the recording head 26 discharges dots while being moved back and forth along the guide rail (main scanning). The medium feeding mechanism 29 transports a printing medium in the transport direction using a roller or the like, which is not shown in the diagrams, due to being controlled by the printer control IC 25. In addition, the printer 20 is provided with a display section 32 which is configured using, for example, a liquid crystal display and an operation section 33 which is configured using, for example, a button, a touch panel, and the like. Here, a device using a line head system may also be adopted as the printer 20.

(2) Explanation of Recording Head

The recording head 26 receives a supply of each type of ink (for example, cyan (C) ink, magenta (M) ink, yellow (Y) ink, black (K) ink, light cyan (Lc) ink, and light magenta (Lm) ink) from ink cartridges with each type of the ink and forms an image on the printing medium by ejecting (discharging) ink droplets (dots) from a plurality of nozzles which are provided to correspond to each type of ink. The printer control IC 25 outputs applied voltage data, which corresponds to raster data which expresses an image which is a target for printing, with regard to the head driving section 27. The head driving section 27 creates and outputs an applied voltage patterns (driving waveforms) for piezoelectric elements, which are formed so as to correspond to each of the nozzles in the recording head 26, from the applied voltage data and discharges dots of each type of ink from each of the nozzles in the recording head 26. In the present embodiment, it is possible for the recording head 26 to discharge a plurality of types of dots, where the amount of ink per dot is different, from each of the nozzles. As an example, each of the nozzles discharges two types of dots where the amount of ink is different, and dots where the amount of ink is large are referred to as large dots and dots where the amount of ink is small are referred to as small dots.

Figure 2:
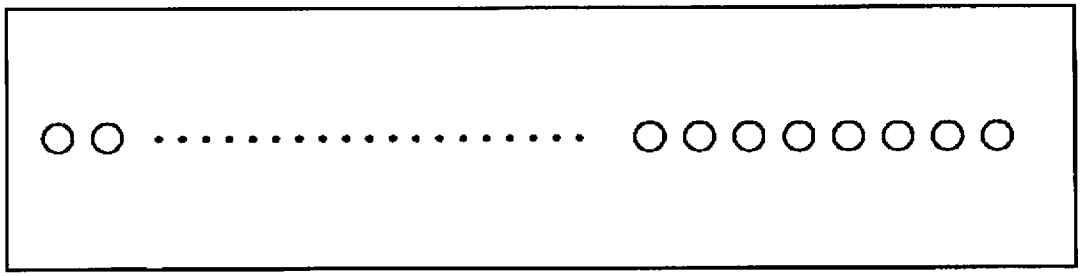
FIG. 2 is a bottom surface diagram illustrating nozzles in a row formation which are formed on a recording head.
Figure 3:
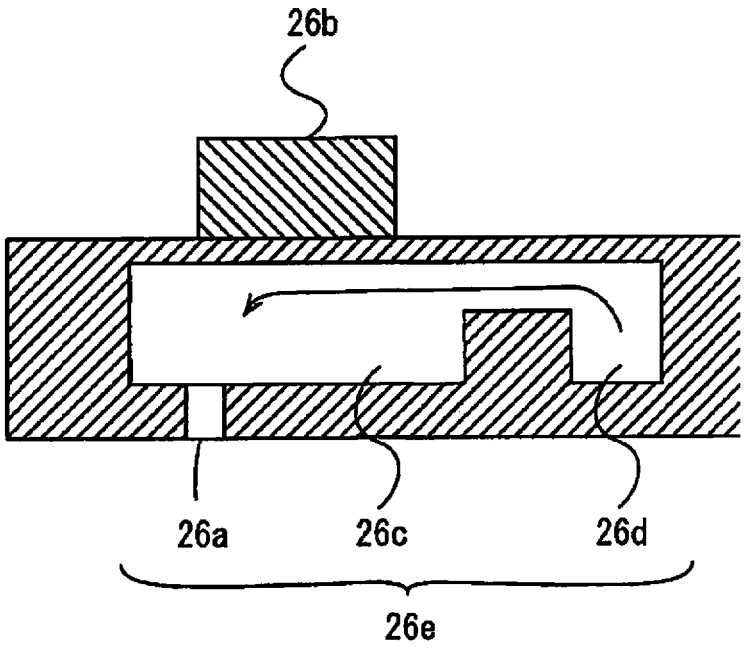
FIG. 3 is a partial cross section diagram of a recording head where a printing flow path, an actuator, and a nozzle are shown.

FIG. 2 illustrates nozzles in a row formation which are formed on the recording head using a bottom surface diagram, and FIG. 3 is a partial cross section diagram of the recording head where a printing flow path, an actuator, and a nozzle are shown.

Multiple nozzles 26*a* are formed on a bottom surface of the recording head 26 so as to be arranged at certain intervals (pitch) in one row. Here, the nozzles 26*a* may be in two rows instead of one row and may have a zig-zag shape instead of a straight line shape. In the recording head 26, an actuator 26*b* is arranged in each one of the nozzles 26*a*. In addition to the nozzle 26*a* which is a discharge opening, a reservoir 26*d* which is linked with an ink cartridge which is not shown in the diagrams is provided in a pressure chamber 26*c* which has a predetermined capacity. A path which reaches from the ink cartridge to the nozzle 26*a* configures an ink flow path 26*e*. The actuator 26*b* is formed using a piezoelectric element and ink droplets are discharged due to the capacity of the pressure chamber 26*c* being changed by the applied voltage pattern being individually applied.

(3) Explanation of Driving Waveforms

Figure 4:
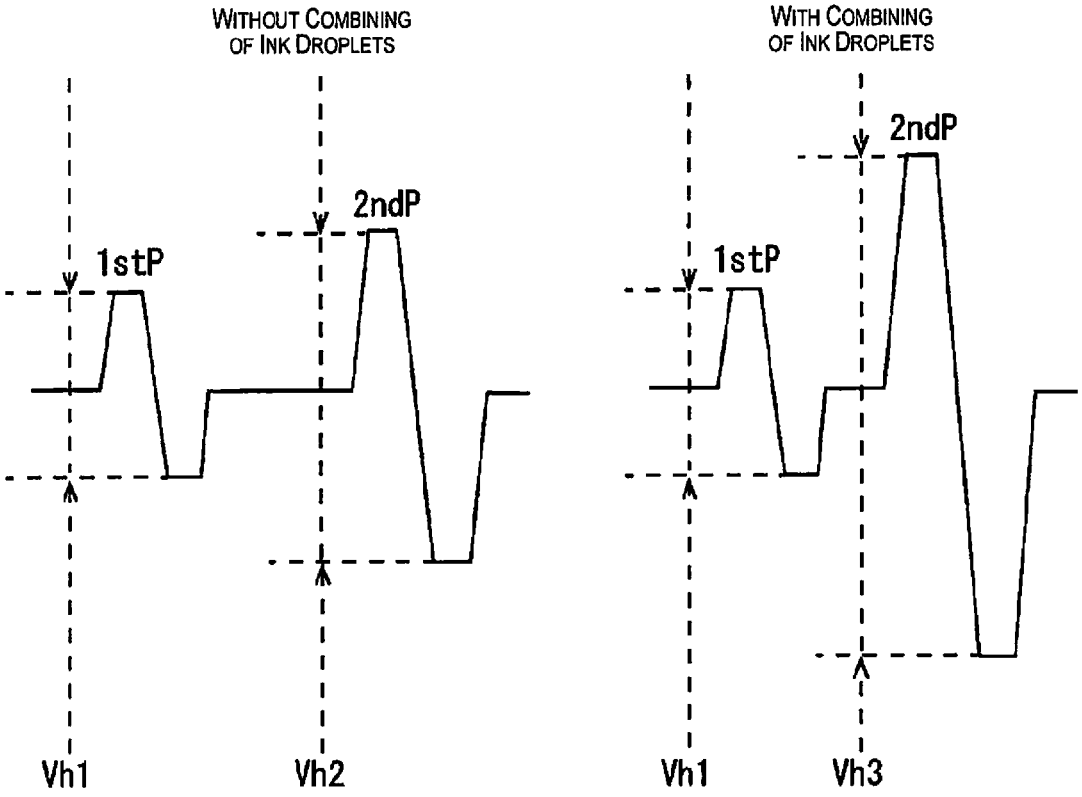
FIG. 4 is a diagram illustrating driving waveforms.
Figure 5A:
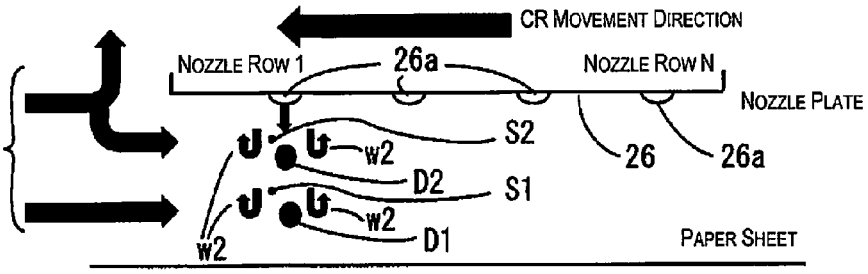
FIGS. 5A, 5B, 5C and 5D are diagrams illustrating a relationship between air flows until ink droplets which are continuously discharged land on a printing medium without being combined together.
Figure 5B:
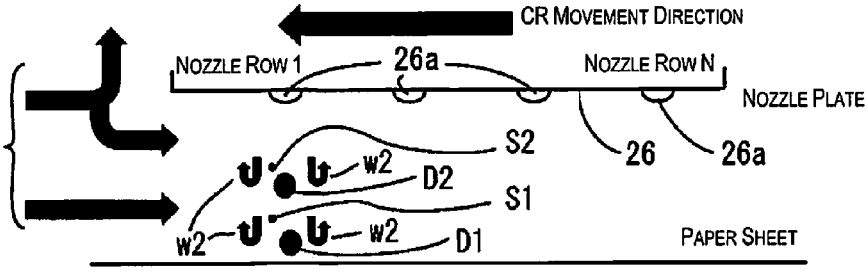
Figure 5C:
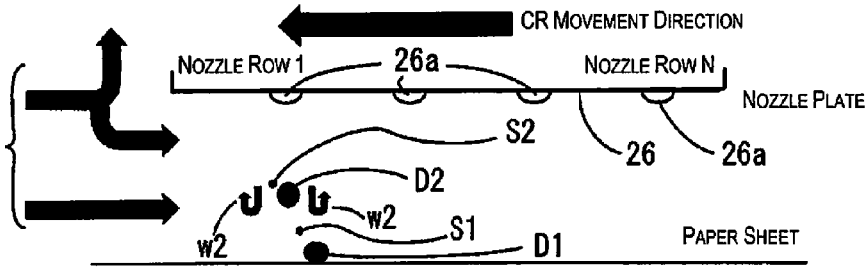
Figure 5D:
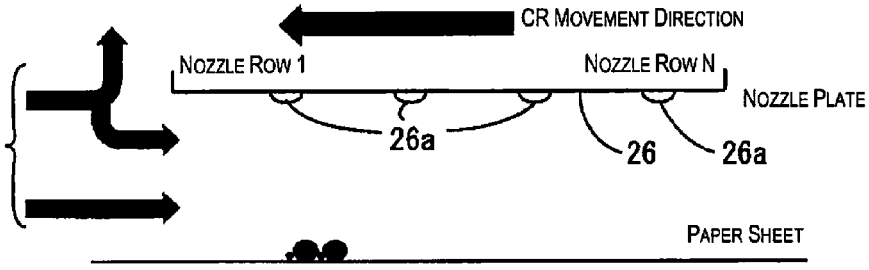

FIG. 4 is a diagram illustrating driving waveforms. The applied voltage data which are output by the printer controller IC 25 are not the same and it is possible for two types of driving waveforms to be output as basic driving waveforms as shown in FIG. 4. The driving waveforms which respectively include two pulses (a $1^{st}$ P and a $2^{nd}$ P) are output in order to form one printing pixel.

In FIG. 4, one set on the left side is a driving waveform for discharging so that subsequent ink droplets and prior ink droplets land at the same position at substantially the same time with regard to the printing medium when ink droplets are discharged continuously. On the other hand, one set on the right side is a driving waveform for discharging so that the subsequent ink droplets combine together with the prior ink droplets when ink droplets are discharged continuously.

Detailed description of each section of the driving waveform is omitted, but the energy which is applied to the actuator 26*b* is substantially proportional to a potential difference from the largest voltage to the smallest voltage for each pulse, and the one set on the left side and the one set on the right side both have Vh1 in common with regard to the first pulse ($1^{st}$ P). However, the one set on the left side has Vh2 with regard to the second pulse ($2^{nd}$ P) and the one set on the right side has Vh3 with regard to the second pulse ($2^{nd}$ P). Here, there is at least the relationship where Vh1<Vh2<Vh3. Vh1 which is applied for the first pulse ($1^{st}$ P) being smaller than Vh2 and Vh3 which are applied for the second pulse ($2^{nd}$ P) indicates that the discharge speed of the prior ink droplets which are discharged using the first pulse is slower than the discharge speed of the subsequent ink droplets which are discharged using the second pulse (the discharge speed of the prior ink droplets which are discharged using the first pulse is different to the discharge speed of the subsequent ink droplets which are discharged using the second pulse). In addition, Vh2 which is applied for the second pulse ($2^{nd}$ P) on the left side being smaller than Vh3 which is applied for the second pulse ($2^{nd}$ P) on the right side indicates that the discharge speed of the subsequent ink droplets which are discharged using the driving pulse on the right side is faster than the discharge speed of the subsequent ink droplets which are discharged using the driving pulse on the left side. The prior ink droplets and the subsequent ink droplets land at substantially the same position at substantially the same time when the driving waveform on the left side is used, but both the prior ink droplets and the subsequent ink droplet combine together in air since the subsequent ink droplets catch up before the prior ink droplets land on the printing medium and the ink droplets, where the weight is increased due to being combined together, travel through air and land on the printing medium when the driving waveform on the right side is used. Here, when Vh1 which is applied for the first pulse ($1^{st}$ P) is the same as Vh2 and Vh3 which are applied for the second pulse ($2^{nd}$ P), the discharge speed of the prior ink droplets which are discharged using the first pulse and the discharge speed of the subsequent ink droplets which are discharged using the second pulse are the same speed and the ink droplets do not combine together.

Figure 6A:
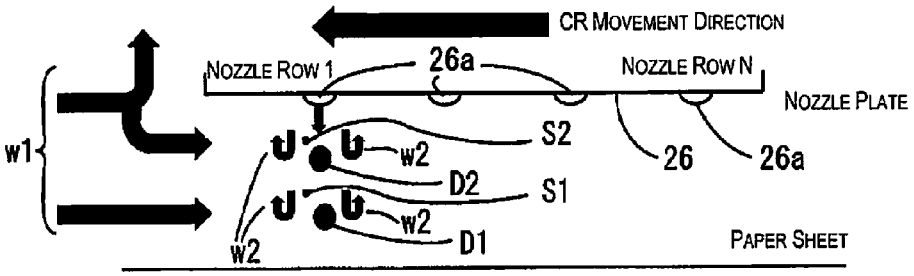
FIGS. 6A, 6B, 6C and 6D are diagrams illustrating a relationship between air flows until ink droplets which are continuously discharged are combined together and land on a printing medium.
Figure 6B:
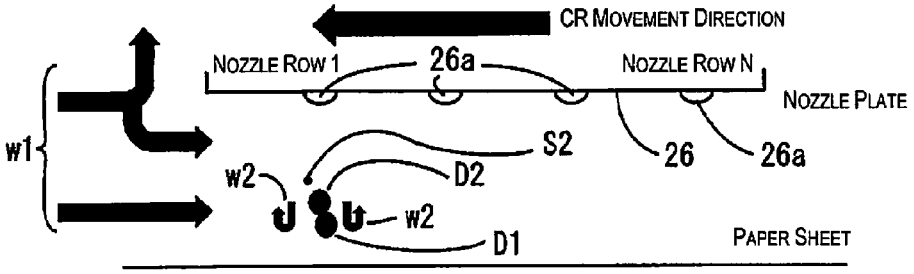
Figure 6C:
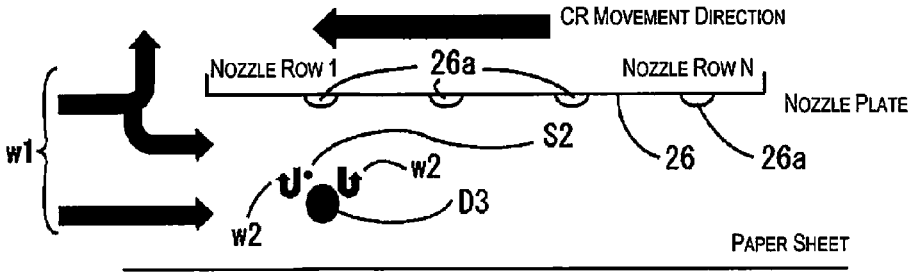
Figure 6D:
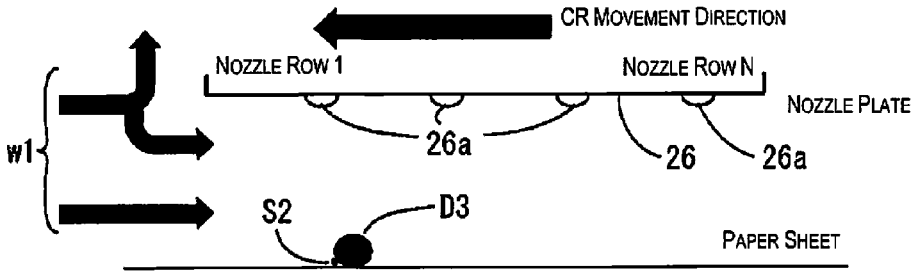

FIGS. 5A to 5D illustrate a relationship between air flows until ink droplets which are continuously discharged land on the printing medium without being combined together using diagrams. FIGS. 6A to 6A illustrates a relationship between air flows until ink droplets which are continuously discharged are combined together and land on the printing medium using diagrams. Here, it is shown that an air flow w1 is created due to movement of the carriage with the recording head 26 and an air flow w2 is created due to discharging of ink droplets.

(4) Explanation of Ink Droplets Combining Together

In FIGS. 5A to 5D, two ink droplets D1 and D2 are discharged continuously from the nozzles 26*a* using the driving waveform shown on the left side in FIG. 4. Here, satellites S1 and S2 with a spray formation, which are generated in accompaniment with discharging of the ink droplets D1 and D2 which are the primary intention, are also shown in FIGS. 5A to 5D. The two ink droplets D1 and D2 travel through air toward the printing medium while each creating the air flow w2. The subsequent ink droplet D2 lands on the printing medium after or substantially at the same time as the prior ink droplet D1 lands on the printing medium. This is because the subsequent ink droplet D2 catches up at a point in time when the prior ink droplet D1 is discharged to the printing medium since the potential different Vh2 of the pulse when discharging the subsequent ink droplet D2 is larger than the potential different Vh1 of the pulse when discharging the prior ink droplet D1 and the discharge speed of the subsequent ink droplet D2 is faster. Here, there is an extremely slight time difference since the two ink droplets D1 and D2 are continuously discharged while the recording head 26 is being moved and one dot is formed with a shape where the two ink droplets D1 and D2 line up in the movement direction of the recording head 26. Here, it is easy for the effects of the air flows w1 and w2 to be received and it is also easy for ripple marks to occur since the ink droplets D1 and D2 are separate while travelling through air.

In contrast to this, in FIGS. 6A to 6D, the two ink droplets D1 and D2 are discharged continuously from the nozzles 26*a* using the driving waveform shown on the right side in FIG. 4. Since the potential difference of the pulse when discharging the subsequent ink droplet D2 is Vh3 which is even larger in the driving waveform shown on the right side of FIG. 4, the subsequent ink droplet catches up with the prior ink droplet D1 in air and becomes an ink droplet D3 which is one large ink droplet due to the two ink droplets being combined together. The ink droplet D3 travels through air toward the printing medium while creating an air flow and lands on the printing medium. It is difficult for the effects of the air flows w1 and w2 to be received and it is also difficult for ripple marks to occur compared to the case where the ink droplets are separate since the weight of the ink droplet D3 is increased due to the two ink droplets being combined together while travelling in air.

FIG. 7 is a diagram illustrating correspondence between driving waveforms, small dots, and large dots.

A large dot (L) is formed due to ink droplets being discharged by using both of the two pulses of $1^{st}$ P and $2^{nd}$ P (ON, ON) in the driving waveforms shown in FIG. 4. On the other hand, a small dot (S) is formed due to ink droplets being discharged by using only the subsequent pulse $2^{nd}$ P (OFF, ON) in the driving waveforms shown in FIG. 4. The applied voltage data, which is the basis for the pulses $1^{st}$ P and $2^{nd}$ P as described above, is created by the printer control IC 25 and an applied voltage pattern (driving waveform) is created and output by using the applied voltage data where the head driving section 27 masks the part of the prior pulse $1^{st}$ P.

(6) Explanation of Printing Control

Figure 8:
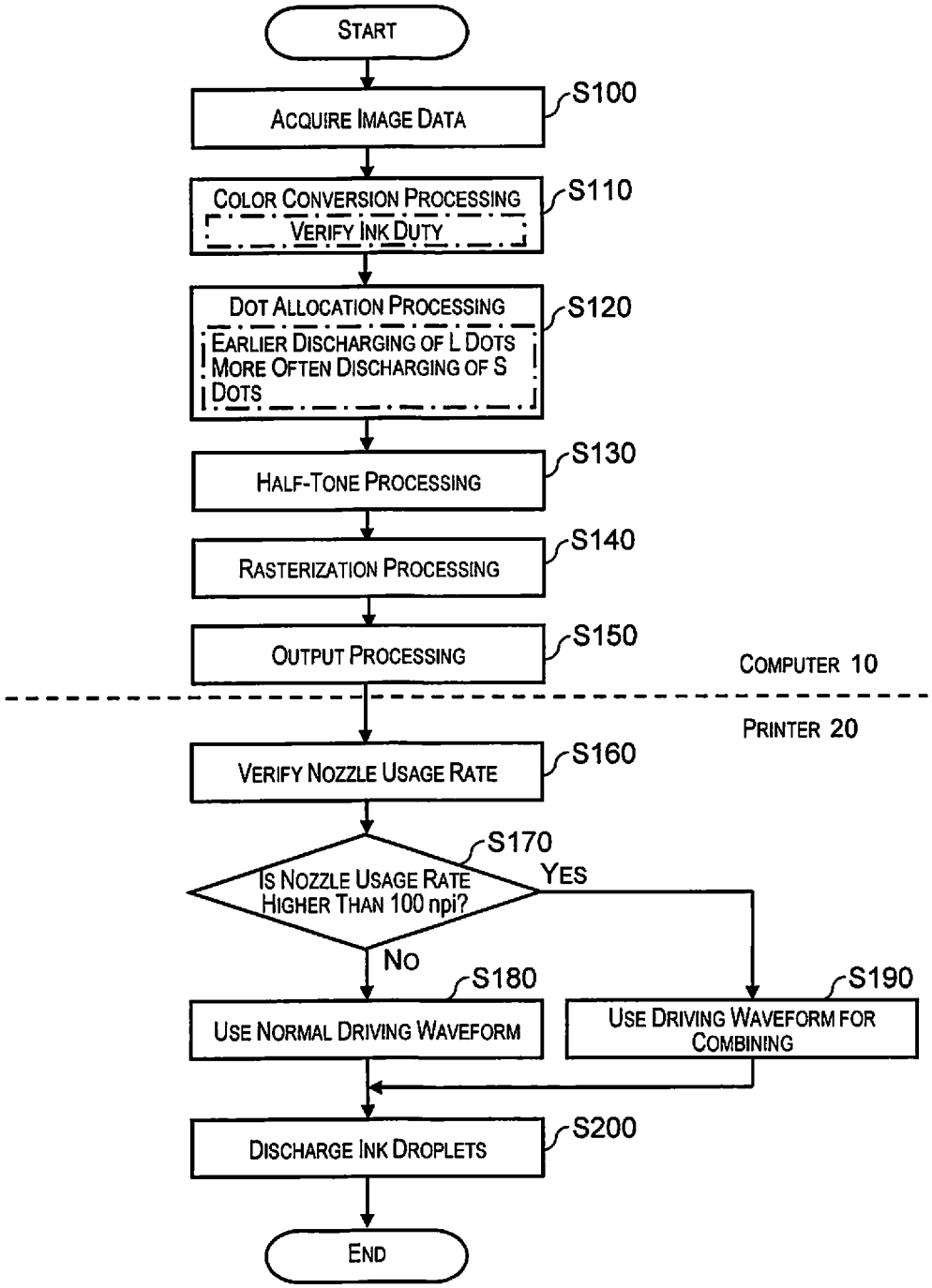
FIG. 8 is a flow chart illustrating printing control which is implemented by a printing control apparatus.

FIG. 8 illustrates printing control which is implemented by the printing control apparatus using a flow chart. Here, the descriptions which are surrounded by one-dot chain lines are not implemented in this applied example.

In step S100, the CPU 11 reads out and acquires image data or the like, which is selected by a user as the target for printing, from a predetermined memory region such as the HD 14. It is possible for a user to arbitrarily select the image data which is the target for printing by operating the operation section 17 while viewing a predetermined UI screen which is displayed on the display section 16. Here, it is possible for the CPU 11 to appropriately execute resolution conversion processing, image quality correction processing, and the like with regard to the image data.

In step S110, the CPU 11 carries out color conversion on the image data which is the target for printing with reference to a color conversion LUT. As a result, the image data, which has a setting for an amount of CMYKLcLm ink, is created for each pixel. In step S120, the CPU 11 converts (carries out dot allocation processing on) each amount of ink (gradation value), which configures the settings for the amounts of ink for each pixel in the image data, to the amount for forming for small and large dots (gradation values) with reference to the dot allocation table.

In step S130, the CPU 11 executes so-called half-tone processing with the image data after dot allocation processing as the target. In the half-tone processing, a well-known method such as a dither method or an error diffusion method is used, and half-tone data, where at least one out of non-discharge of dots, small dot discharge, or large dot discharge is specified, is created for each pixel which configures the image data and each type of ink. In step S140, the CPU 11 carries out predetermined rasterization processing with regard to half-tone data and creates raster data for each type of ink where data is sorted in the order in which the recording head 26 discharges ink. In step S150, the CPU 11 outputs a printing command, which includes raster data, to the printer 20 via the I/F 18. The printer 20 executes the processing of step S160 and beyond after the processing as above on the computer 10 side is complete.

(7) Explanation of Printing Control With Printer

In theory, when the raster data is input under the control using the printer control IC 25, a printing process as described above is executed at the printer 20 side based on one of the driving waveforms for each of the nozzles 26*a*.

In the present applied example, at the printer 20 side, the CPU 21 in the printer control IC 25 verifies a nozzle usage rate in step S160. The recording head 26 is also moving back and forth above the printing medium when the carriage is moving back and forth above the printing medium due to the carriage mechanism 28 since the raster data is already input. The plurality of nozzles 26*a* are formed on the recording head 26 with a predetermined pitch, and it is understood from which of the nozzles 26*a* will discharge ink droplets at each of the pixel positions in a row direction among the printing pixels when the raster data is referenced. Accordingly, it is possible to calculate the nozzle usage rate if it is determined that ink droplets will be discharged from several of the nozzles 26*a* since the number of the nozzles 26*a* and the pitch of the nozzles 26*a* are fixed.

For example, the pitch of the nozzles 26*a* is 360 dpi and the number of the nozzles 26*a* is 180. The usage rate is 360 npi if all 180 of the nozzles 26*a* are used. The usage rate is 180 npi if 90 of the nozzles 26*a* are used. Conversely, to have a usage rate of 100 npi, 50 of the nozzles 26*a* are used.

There are changes in ripple marks being generated due to various types of conditions, but it is easy for ripple marks to occur when the nozzle usage rate is 100 npi or more in the present applied example where the nozzles 26*a* with a pitch of 360 dpi is used. For this reason, the CPU 21 in the printer control IC 25 verifies the nozzle usage rate at each of the pixel positions in the row direction in step S160 based on the raster data.

In addition, it is determined whether or not the nozzle usage rate is 100 npi or less in step S170, and if the nozzle usage rate is 100 npi or less, the driving waveform is formed by using normal applied voltage data in step S180. On the other hand, if the nozzle usage rate exceeds 100 npi, the driving waveform is formed by using applied voltage data for combining in step S190. Then, in step S200, discharging of ink droplets is performed due to the actuators 26*b* in each of the nozzles 26*a* being driven using the respective driving waveforms. Here, step S160 to S200 are implemented repeatedly while there is raster data. When carrying out printing control as above, the actuators 26*b* in the recording head 26 are driven so that dots in a region where the nozzle usage rate is higher than 100 npi (a predetermined threshold) are printed by ink droplets, where ink droplets which are continuously discharged are combined together in air, adhering to the printing medium.

Here, a control means is realized using a configuration of software which executes steps S160 to S200 and a configuration of hardware which executes this software. Supplying of driving power with regard to each of the actuators 26*b* is carried out by the head driving section 27, and it being possible to supply driving power with a plurality of waveforms at this time is due to the printer control IC 25 outputting a plurality of applied voltage patterns and the head driving section 27 forming the driving waveforms based on this. Accordingly, a driving circuit is realized using by both the printer control IC 25 and the head driving section 27. The processing of step S160 is processing for acquiring the usage rate per unit of time for the plurality of nozzles which are arranged in a row formation for each predetermined region and is equivalent to a nozzle usage rate acquiring means. In addition, with the assumption of the verifying in step S160, switching of the waveforms for driving power which is supplied based on the nozzle usage rate which is acquired in step S170 is equivalent to processing by the control means.

In the present applied example, the subsequent ink droplets D2 are discharged so as to combine with the prior ink droplets D1 for dots in a region where the nozzle usage rate is higher than 100 npi (the predetermined threshold), and the subsequent ink droplets D2 and the prior ink droplets D1 are discharged with regard to the printing medium so as to land at the same position at substantially the same time for dots in a region where the nozzle usage rate is 100 npi (the predetermined threshold) or less.

Applied Example 1

In the present applied example, dot allocation processing is performed so that regions, where the nozzle usage rate is higher than the predetermined threshold, are estimated based on the printing data, and there are large dots where the prior ink droplets and the subsequent ink droplets which are continuously discharged are created to be combined together in this region.

The nozzle usage rate is exactly determined using raster data but it is thought that the nozzle usage rate is larger when ink duty is large by using the printing data which is the basis for creating raster data.

Figure 9:
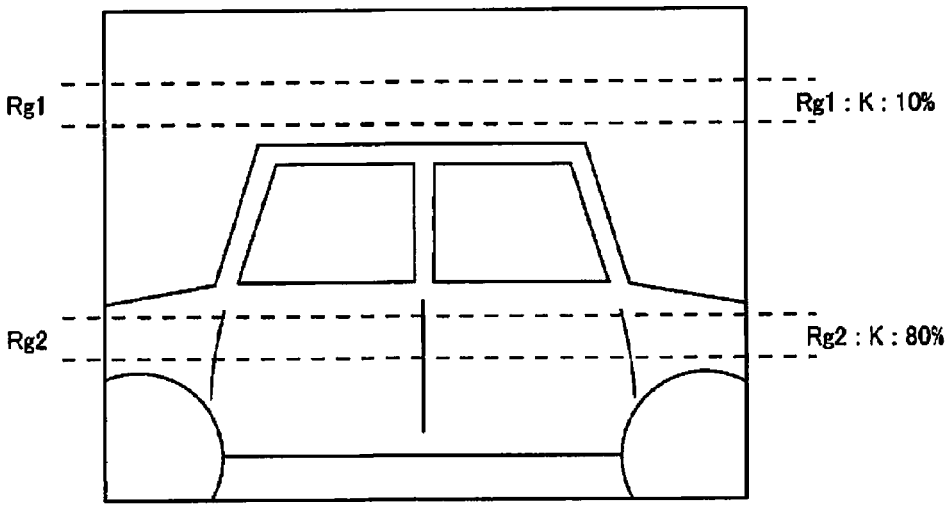
FIG. 9 is a diagram for explaining estimating of a usage rate based on printing data.

FIG. 9 is a diagram for explaining estimating of the usage rate based on the printing data.

A case is assumed of, for example, image data, where the background is white and a black car is moving, as printing data. As shown in FIG. 9, the black ink usage rate is determined for each of a region Rg1 where the background is dominant in an upper part of the diagram and a region Rg2 where the car is dominant in a lower part of the diagram. In this example, the black ink usage rate is 10% in the region Rg1 and the black ink usage rate is 80% in the region Rg2. In the applied example described above, the nozzle usage rate exceeds 100 npi when 50 or more of the nozzles 26*a* out of 180 of the nozzles 26*a* are used. The ink usage rate is not proportional to the nozzle usage rate without any changes, but since it is possible to provide a table for converting where the correspondence relationship between the nozzle usage rate and the ink usage rate is set, it possible to estimate the nozzle usage rate from the printing data through a table for converting the ink usage rate to the nozzle usage rate.

Figure 10:
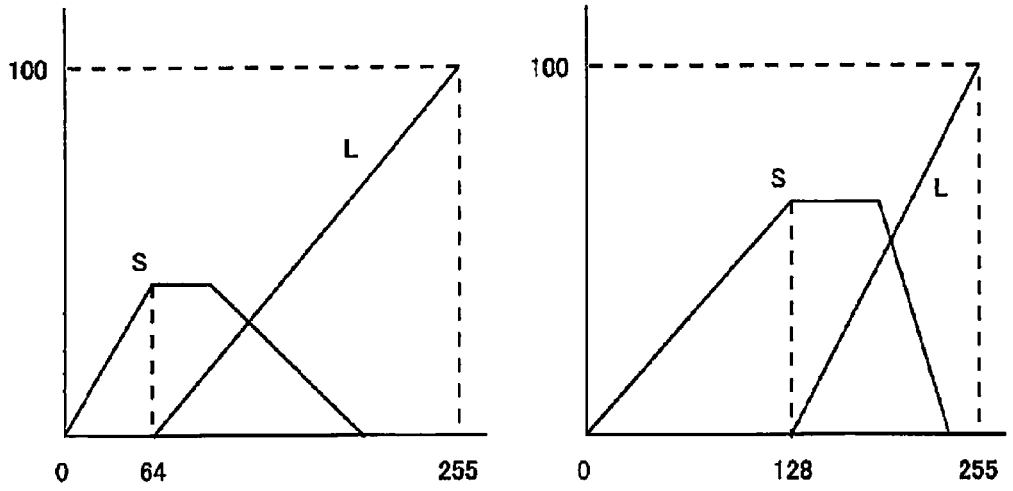
FIG. 10 is a diagram illustrating a table which is used in dot allocation.

FIG. 10 is a diagram illustrating a table which is used in dot allocation.

For example, certain effects occur as countermeasures against ripple marks even when the driving waveform is provided so that the prior ink droplets and the subsequent ink droplets are combined together and L dots are commonly generated in region where it is easy for ripple marks to occur and S dots are generated as much as possible in cases where it is difficult for ripple marks to occur. The SL table shown in FIG. 10 is used in place of the reference SL table 14*b*. There is a tendency for L dots to be generated with a relative wide range for the amounts of ink on the left graph in FIG. 10 and it can be said that dots where ink droplets are combined are commonly used. On the other hand, there is a tendency for S dots to be generated with a relative wide range for the amounts of ink on the right graph in FIG. 10 and there is an effect where granularity does not deteriorate by printing with S dots where possible.

When printing control is implemented in accordance with the flow chart shown in FIG. 8, the CPU 11 in the computer 10 converts to the gradation values with color ink when printing at a point in time when color conversion processing is carried out in step S110. The CPU 11 uses the printing data and verifies the ink duty for each of the inks in each of the regions as shown in FIG. 9. Then, in step S120, the CPU 11 switches between using the dot allocation table shown on the left in FIG. 10 where there is a tendency for L dots to be discharged earlier and using the dot allocation table shown on the right in FIG. 10 where S dots are more often discharged when carrying out dot allocation processing with S dots and L dots. In more detail, the dot allocation table shown on the right in FIG. 10 is more often used with regard to the region Rg1 in FIG. 9 and the dot allocation table shown on the left in FIG. 10 is more often used with regard to the region Rg2 in FIG. 9.

By doing this, while the ink droplets, which are combined together are often used in regions where the nozzle usage rate is higher than the predetermined threshold, it is possible for the S dots to be used as much as possible in regions where ink duty is low, for example, equal to or less than 30%. Here, in the examples in FIG. 10, generating of L dots starts when the ink gradation value is 64 or more in the example on the left and generating of L dots starts when the ink gradation value is 128 or more in the example on the right. However, this is only one example, and the nozzle usage rate where it is easy for ripple marks to be generated, the ink duty where it is difficult for ripple marks to be generated, and the like may be verified for each printer and gradation values for switching between S dots and L dots may be set so as to match the respective conditions.

By doing this, it is possible to print using single dots in a region where the nozzle usage rate is the predetermined threshold or less based on the nozzle usage rate.

Applied Example 2

There is a relationship in that it is easy for ripple marks to be generated when the distance between the recording head and the printing medium is wide and it is difficult for ripple marks to be generated when the distance between the recording head and the printing medium is narrow. It is possible for this effect to be utilized in switching of the driving waveforms in step S170.

FIG. 11 is a diagram illustrating correspondence between distances between the recording head and the printing medium and the threshold for the nozzle usage rate. FIG. 11 shows the relationship between a distance PG between the recording head and the printing medium and a threshold NPIth.

Since it is difficult for ripple marks to be generated even if the nozzle usage rate is relatively high in a case where PG is 1 mm or less, the threshold which is used when determining whether or not to combine together the ink droplets in air is 150 npi instead of being 100 npi or less. The threshold is 125 npi when PG is slightly wider and is in the range of 1 mm to 2 mm and it is slightly easier for ripple marks to be generated, and the threshold is 100 npi in consideration of it being easy for ripple marks to be generated when PG is in a range of 2 mm or more.

The relationship between the printing medium and PG is stored as a table or the like in the printer 20 since there are cases where PG differs depending on the printing medium. The CPU 11 acquires the thresholds shown in FIG. 11 along with acquiring PG which corresponds to the printing medium from a table or the like when a user specifies the printing medium via a UI or the like. The threshold is sent to the printer 20 as attached data when a printing command is sent from the computer 10 to the printer 20. It is possible for this threshold to be reflected in switching of the driving waveforms in the printer 20 by being utilized as the threshold in determining in step S170.

In this manner, the threshold for whether or not to combine together the prior ink droplets and the subsequent ink droplets which are continuously discharged is modified according to the distance between the recording head and the printing medium.

Applied Example 3

The difficulty of bleeding in the printing medium and ripple marks being generated are related. That is, it is difficult for ripple marks to be generated even though the positional precision of the ink droplet adhering position deteriorates due to the effects of air flows being received since it is easy for dots to spread if bleeding is easy. On the other hand, ripple marks appear when the positional precision of the ink droplet adhering position deteriorates due to the effects of air flows being received if bleeding is difficult.

It is possible to determine if bleeding is easy or bleeding is difficult in the printing medium using a UI where the type of printing medium is selected when printing.

FIG. 12 illustrates a parameter and a UI which relates to the difficulty of bleeding using a table. First, the printing medium and a parameter are associated from the point of view of the ease of bleeding since generality deteriorates when the type of printing medium is directly associated with the threshold for the nozzle usage rate.

(80) is written with normal paper as the printing medium. As one example, there is an example where the diameter of the ink droplets and the diameter of the dots on the printing medium are compared under specific environments and the difference in the diameters is represented as a percentage. The diameter of the dot is represented as an 80% increase on the diameter of the ink droplets in the case of normal paper. The diameter of the dot is respectively represented as a 60% increase and a 30% increase on the diameter of the ink droplets for ink jet paper and glossy photo paper.

Figure 13:
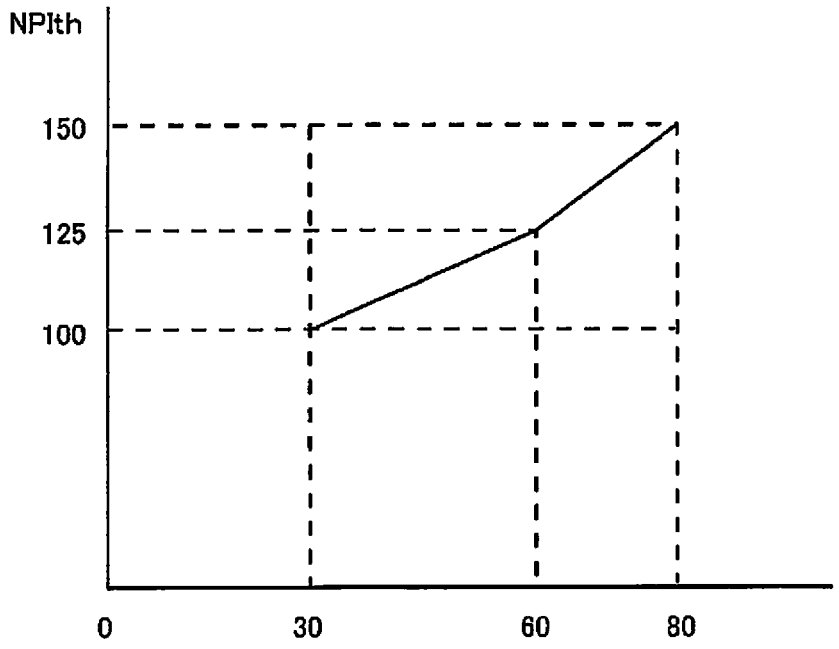
FIG. 13 is a diagram illustrating correspondence between a parameter and a threshold for a usage rate.

Next, FIG. 13 illustrates correspondence between the parameter and the threshold for the usage rate using a graph.

The threshold is modified based on the ease of spreading of the ink droplet on the printing medium. If the parameter for the ease of bleeding is, for example, 30 (30% increase), the threshold which is used in step S170 is 100 npi since it is easy for ripple marks to be generated. If the parameter for the ease of bleeding is 80 (80% increase), the threshold which is used in step S170 is 150 npi since it is difficult for ripple marks to be generated. The threshold is 125 npi in the case of ink jet paper which is between the other cases in terms of difficulty of bleeding.

When a user specifies the printing medium via a UI or the like, the CPU 11 acquires the corresponding threshold shown in FIG. 13 along with acquiring the parameter which corresponds to the printing medium. The computer 10 sends the threshold to the printer 20 as attached data when sending a printing command to the printer 20. It is possible for this threshold to be reflected in switching of the driving waveforms in the printer 20 by being utilized as the threshold in determining in step S170.

In this manner, the threshold for whether or not to combine together the prior ink droplets and the subsequent ink droplets which are continuously discharged is modified according to the parameter which represents the difficulty of bleeding in the printing medium.

As other terms which have a wider meaning than ink, it is possible to use "color material", "coloring material", and "coloring agent".

Here, it is obvious that the present invention is not limited to the applied examples. It would be obvious to a person skilled in the art that:

applying appropriate modifications to the combinations of members, configurations, and the like which are disclosed in the applied examples and which are able to be mutually interchanged, applying appropriate interchanging and modifications to the combinations of members, configurations, and the like which are able to be mutually interchanged with members, configurations, and the like, which are known techniques and which are disclosed in the applied examples even though these are not disclosed in the applied examples, applying appropriate interchanging and modifications to the combinations of members, configurations, and the like which are able to be assumed as substitutes for members, configurations, and the like which are disclosed in the applied examples to a person skilled in the art based on known techniques and the like even though these are not disclosed in the applied examples, are disclosed as applied example of the present invention.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only a selected embodiment has been chosen to illustrate the present invention, it will be apparent to those skilled in the art from this disclosure that various changes and modifications can be made herein without departing from the scope of the invention as defined in the appended claims. Furthermore, the foregoing descriptions of the embodiment according to the present invention are provided for illustration only, and not for the purpose of limiting the invention as defined by the appended claims and their equivalents.

What is claimed is:

1. A printing control apparatus configured to use a recording head where a plurality of nozzles that respectively link with predetermined ink paths are arranged in a row formation to discharge ink droplets from each of the nozzles by individually supplying predetermined driving power with regard to actuators that are respectively arranged in the ink paths, and configured to discharge the ink droplets with different discharge speeds so that subsequent ink droplets catch up with and combine together with prior ink droplets that are continuously discharged before the prior ink droplets land on a printing medium, the printing control apparatus comprising:

a control section configured to drive the actuators in the recording head so that dots that are in a region where a nozzle usage rate is higher than a predetermined threshold are printed due to ink droplets, where ink droplets that are continuously discharged combine together in air, attaching to the printing medium, the control section including a nozzle usage rate acquiring section that is configured to acquire a usage rate for a plurality of nozzles that are arranged in a row formation in each predetermined region per unit of time as the nozzle usage rate.

2. The printing control apparatus according to claim 1, wherein the control section is configured to discharge the subsequent ink droplets so as to combine together with the prior ink droplets with regard to the dots that are in the region where the nozzle usage rate is higher than the predetermined threshold, and is configured to discharge the subsequent ink droplets and the prior ink droplets with regard to the printing medium so as to land to line up in a movement direction of the recording head at substantially the same time with regard to dots that are in a region where the nozzle usage rate is the predetermined threshold or less.

3. The printing control apparatus according to claim 1, wherein the control section includes a driving circuit that is configured to supply driving power with a plurality of waveforms that are respectively supplied with regard to the actuators, and the control section being further configured to switch waveforms of the driving power that are supplied based on the nozzle usage rate that is acquired by the nozzle usage rate acquiring section.

4. The printing control apparatus according to claim 1, wherein the control section is configured to estimate the region where the nozzle usage rate is higher than the predetermined threshold based on printing data, and is configured to perform dot allocation processing that creates large dots that are created by combining together the prior ink droplets and the subsequent ink droplets that are continuously discharged at the region.

5. The printing control apparatus according to claim 1, wherein the control section is configured to modify a threshold for whether or not to combine together the prior ink droplets and the subsequent ink droplets that are continuously discharged according to a distance between the recording head and the printing medium.

6. The printing control apparatus according to claim 1, wherein the control section is configured to modify a threshold for whether or not to combine together the prior ink droplets and the subsequent ink droplets that are continuously discharged according to a parameter that represents difficulty of bleeding in the printing medium.

7. The printing control apparatus according to claim 1, wherein the control section is configured to print using single dots in a region where the nozzle usage rate is the predetermined threshold or less based on the nozzle usage rate.

8. A printing control method for using a recording head where a plurality of nozzles that respectively link with predetermined ink paths are arranged in a row formation to discharge ink droplets from each of the nozzles by individually supplying predetermined driving power with regard to actuators that are respectively arranged in the ink paths, and for discharging the ink droplets with different discharge speeds so that subsequent ink droplets catch up with and combine together with prior ink droplets that are continuously discharged before the prior ink droplets land on a printing medium, the printing control method comprising:

driving the actuators in the recording head so that dots that are in a region where a nozzle usage rate is higher than a predetermined threshold are printed due to ink droplets, where ink droplets that are continuously discharged combine together in air, attaching to the printing medium, the nozzle usage rate being a usage rate for a plurality of nozzles that are arranged in a row formation in each predetermined region per unit of time.

* * * * *